US012467447B2

(12) United States Patent
Kawabata

(10) Patent No.: US 12,467,447 B2
(45) Date of Patent: Nov. 11, 2025

(54) FIRST AND SECOND PIEZOELECTRIC PUMPS AND CONNECTION PIPE ARRANGEMENT

(71) Applicant: Murata Manufacturing Co., Ltd., Kyoto (JP)

(72) Inventor: Yutoku Kawabata, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 139 days.

(21) Appl. No.: 18/365,342

(22) Filed: Aug. 4, 2023

(65) Prior Publication Data

US 2024/0018954 A1 Jan. 18, 2024

Related U.S. Application Data

(63) Continuation of application No. PCT/JP2022/006291, filed on Feb. 17, 2022.

(30) Foreign Application Priority Data

Feb. 22, 2021 (JP) ..... 2021-025858

(51) Int. Cl.
*F04B 43/04* (2006.01)
*F04B 53/08* (2006.01)
*F04B 53/16* (2006.01)

(52) U.S. Cl.
CPC ..... *F04B 43/046* (2013.01); *F04B 53/08* (2013.01); *F04B 53/16* (2013.01)

(58) Field of Classification Search
CPC ..... F04B 43/046; F04B 53/08; F04B 53/16
See application file for complete search history.

(56) References Cited

U.S. PATENT DOCUMENTS

| | | | | |
|---|---|---|---|---|
| 9,217,426 | B2 * | 12/2015 | Wackerle | F04B 23/06 |
| 2006/0281398 | A1 | 12/2006 | Yokomizo et al. | |
| 2018/0187672 | A1 | 7/2018 | Tanaka et al. | |
| 2020/0246556 | A1 | 8/2020 | Osoegawa et al. | |

FOREIGN PATENT DOCUMENTS

| | | | |
|---|---|---|---|
| CN | 1399070 A | * | 2/2003 |
| CN | 103925187 A | * | 7/2014 |
| CN | 203892161 U | * | 10/2014 |
| CN | 108496004 A | | 9/2018 |
| CN | 109854490 A | * | 6/2019 |
| CN | 116635632 A | | 8/2023 |

(Continued)

OTHER PUBLICATIONS

English Machine translation of CN-109854490-A (Year: 2019).*
International Search Report for PCT/JP2022/006291 dated Apr. 5, 2022.

*Primary Examiner* — Nathan C Zollinger
(74) *Attorney, Agent, or Firm* — McDonald Hopkins LLC

(57) ABSTRACT

A pump device includes a piezoelectric pump, a piezoelectric pump, and a connection pipe. The connection pipe causes a discharge port of the piezoelectric pump to be in communication with a suction port of the piezoelectric pump. The piezoelectric pump and the piezoelectric pump are disposed such that a suction-side outer wall surface in a housing of the piezoelectric pump and a suction-side outer wall surface in a housing of the piezoelectric pump face each other.

5 Claims, 4 Drawing Sheets

(56) References Cited

FOREIGN PATENT DOCUMENTS

| | | | | |
|---|---|---|---|---|
| JP | H07-301182 | A | 11/1995 | |
| JP | 2006-336641 | A | 12/2006 | |
| JP | 2016-200067 | A | 12/2016 | |
| JP | 2019-076243 | A | 5/2019 | |
| WO | WO-03027503 | A1 * | 4/2003 | ..... F04B 43/046 |
| WO | 2017/038565 | A1 | 3/2017 | |

* cited by examiner

FIRST AND SECOND PIEZOELECTRIC PUMPS AND CONNECTION PIPE ARRANGEMENT

CROSS REFERENCE TO RELATED APPLICATION

This is a continuation of International Application No. PCT/JP2022/006291 filed on Feb. 17, 2022 which claims priority from Japanese Patent Application No. 2021-025858 filed on Feb. 22, 2021. The contents of these applications are incorporated herein by reference in their entireties.

BACKGROUND OF THE DISCLOSURE

Field of the Disclosure

The present disclosure relates to a pump device in which a plurality of pumps is connected.

Description of the Related Art

Patent Document 1 describes a nebulizer that sprays a liquid such as a medical solution. The nebulizer described in Patent Document 1 includes an ultrasonic vibrator as a driving unit for spraying.

A piezoelectric pump can be adopted as a driving unit for such a nebulizer. In addition, in order to achieve predetermined spraying performance, a plurality of piezoelectric pumps may be used.

Patent Document 1: Japanese Unexamined Patent Application Publication No. 2019-76243

BRIEF SUMMARY OF THE DISCLOSURE

However, since a piezoelectric pump generates heat when being driven, it is preferable to use a heat dissipation mechanism. In particular, when a device on which a piezoelectric pump of a nebulizer and the like is mounted is reduced in size, it is desirable to save a space for an area where a plurality of the piezoelectric pumps is disposed.

Therefore, a possible benefit of the present disclosure is to provide a configuration in which heat dissipation is effectively performed in a plurality of piezoelectric pumps while the plurality of piezoelectric pumps is disposed in a saved space.

A pump device of the present disclosure includes a first piezoelectric pump, a second piezoelectric pump, and a connection pipe. The first piezoelectric pump and the second piezoelectric pump each include a housing having an internal space in which a vibration plate that vibrates by driving of a piezoelectric element is disposed, a suction port that is in communication with a first space surrounded by the housing and one main surface of the vibration plate in the internal space of the housing, and a discharge port that is in communication with a second space surrounded by the housing and another main surface of the vibration plate in the internal space of the housing. The connection pipe causes the discharge port of the first piezoelectric pump to be in communication with the suction port of the second piezoelectric pump.

The first piezoelectric pump and the second piezoelectric pump are disposed such that an outer wall surface on a first space side in the housing of the first piezoelectric pump faces an outer wall surface on a first space side in the housing of the second piezoelectric pump.

In this configuration, even when the first piezoelectric pump and the second piezoelectric pump are disposed such that the housings of the first pump and the second pump come close to each other, portions on high temperature sides in the housings of the first pump and the second pump do not face each other and are separated from each other. Therefore, the heat from the housing of the first pump and the heat from the housing of the second pump are easily dissipated.

According to the present disclosure, heat dissipation can be effectively performed while a plurality of piezoelectric pumps is disposed in a saved space.

DETAILED DESCRIPTION OF THE DISCLOSURE

First Embodiment

Figure 1:
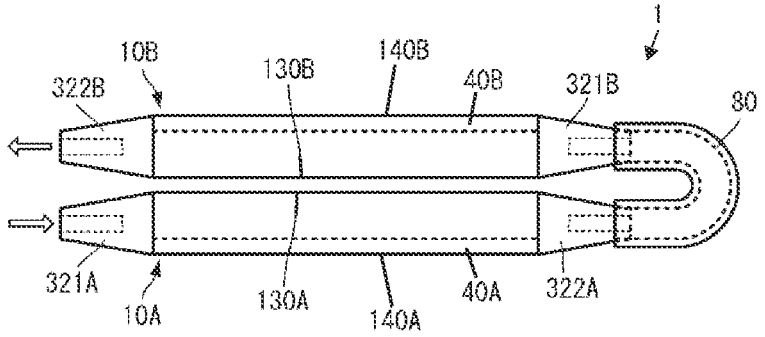
FIG. 1 is a side view illustrating a configuration of a pump device according to a first embodiment.

A pump device according to a first embodiment of the present disclosure will be described with reference to the drawings. FIG. 1 is a side view illustrating a configuration of the pump device according to the first embodiment. Note that in the figures illustrated in each embodiment including the present embodiment, the shape of each constituent is partly or as a whole exaggerated such that the configurations of the pump device can be easily understood.

As illustrated in FIG. 1, a pump device 1 includes a piezoelectric pump 10A, a piezoelectric pump 10B, and a connection pipe 80. The piezoelectric pump 10A and the piezoelectric pump 10B have the same configurations. The piezoelectric pump 10A and the piezoelectric pump 10B are connected in series with respect to a flow of a fluid by the connection pipe 80. The pair of the piezoelectric pump 10A and the piezoelectric pump 10B corresponds to a pair of a "first piezoelectric pump" and a "second piezoelectric pump" of the present disclosure.

(Configuration Example of Piezoelectric Pump)

Figure 2:
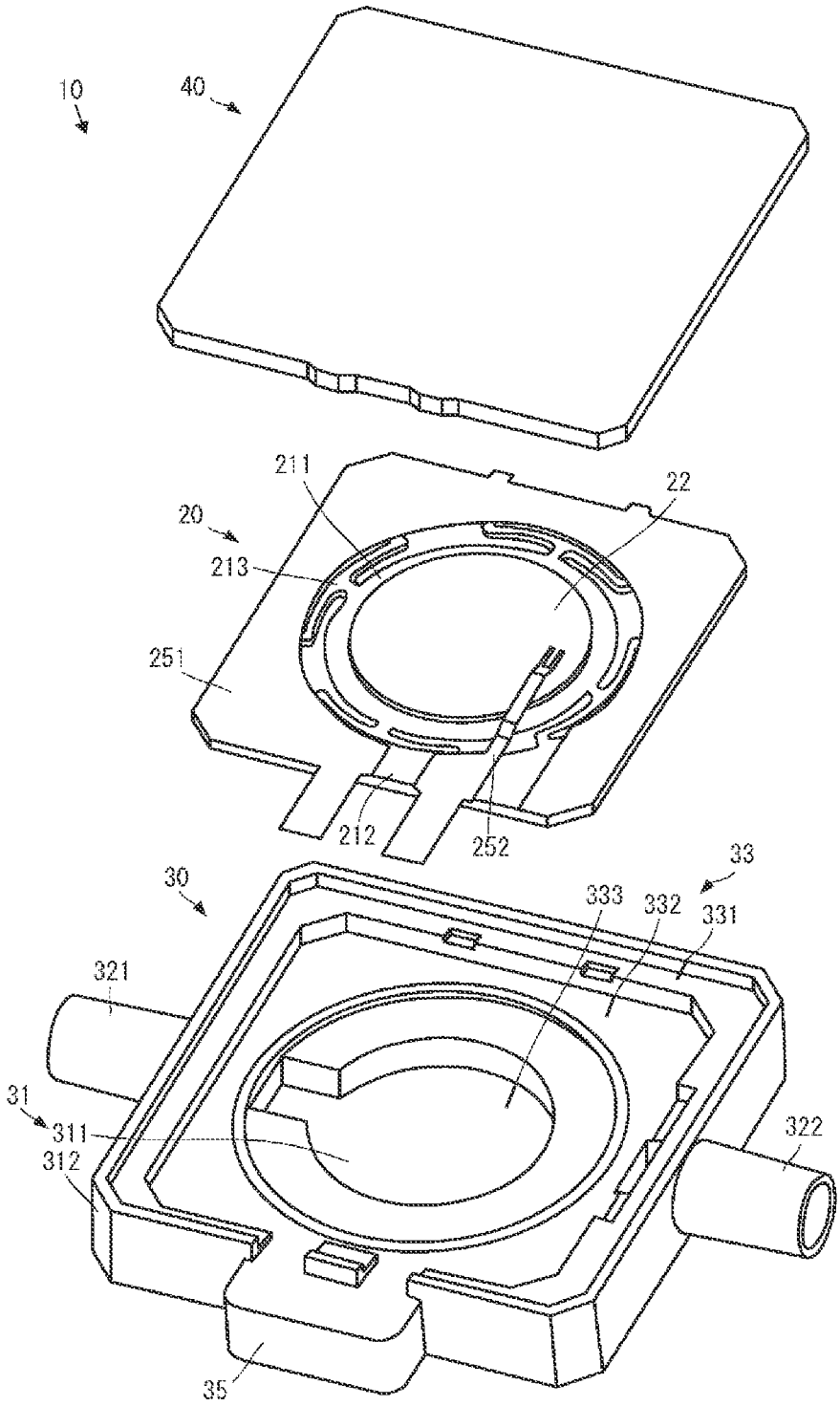
FIG. 2 is an exploded perspective view of a piezoelectric pump according to the first embodiment.
Figure 3:
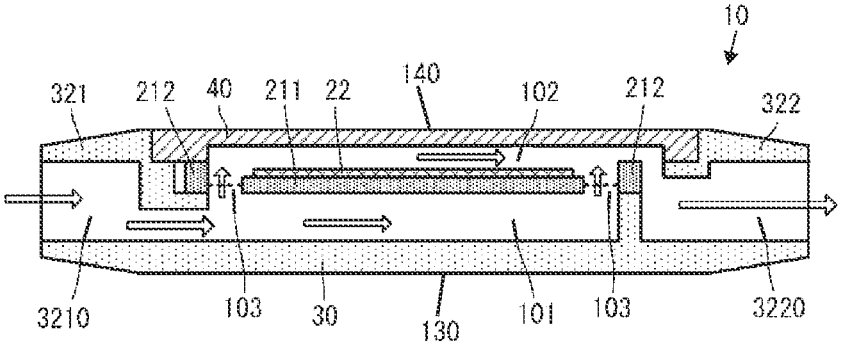
FIG. 3 is a schematic view of a side section illustrating a flow of a fluid in the piezoelectric pump according to the first embodiment.

FIG. 2 is an exploded perspective view of a piezoelectric pump according to the first embodiment. FIG. 3 is a schematic view of a side section illustrating a flow of a fluid in the piezoelectric pump according to the first embodiment. Note that in FIGS. 2 and 3, a piezoelectric pumps 10 will be described in place of the piezoelectric pumps 10A and 10B.

The piezoelectric pump 10 includes a pump body 20, a base housing 30, and a lid member 40. A "housing" of the present disclosure is configured by the base housing 30 and the lid member 40.

The pump body 20 includes a vibration plate 211, a frame 212, a support 213, and a piezoelectric element 22. The vibration plate 211 has a circular shape in plan view. The frame 212 has a shape surrounding the outer peripheral edge of the vibration plate 211 and is disposed at a position separated from the outer peripheral edge of the vibration plate 211. The support 213 is disposed between the vibration plate 211 and the frame 212. The support 213 has a beam shape and supports the vibration plate 211 such that the vibration plate 211 can vibrate with respect to the frame 212.

The piezoelectric element 22 includes a piezoelectric body having a disc shape and a drive electrode. The piezoelectric element 22 is installed on one main surface of the vibration plate 211. A drive signal is applied to the piezoelectric element 22 by a drive signal application electrode 251 and a drive signal application electrode 252.

The base housing 30 includes a main member 31, a suction-side nozzle 321, a discharge-side nozzle 322, and a terminal mount portion 35. The main member 31, the suction-side nozzle 321, the discharge-side nozzle 322, and the terminal mount portion 35 are integrally molded with, for example, an insulating resin material.

The main member 31 includes a bottom wall 311 and a side wall 312. The main member 31 includes a recessed portion 33 surrounded by the bottom wall 311 and the side wall 312. The recessed portion 33 is formed of a recessed portion 333 in the center in plan view, a recessed portion 332 disposed at the outer periphery of the recessed portion 333, and a recessed portion 331 disposed further at the outer periphery of the recessed portion 332 and in contact with the inner edge of the side wall 312. The recessed portion 333 is deeper than the recessed portion 332, and the recessed portion 332 is deeper than the recessed portion 331.

The suction-side nozzle 321 and the discharge-side nozzle 322 are attached to the outer surface of the side wall 312 of the main member 31. A suction port 3210 provided in the suction-side nozzle 321 is in communication with the recessed portion 333 of the main member 31 through a through hole penetrating the side wall 312 in a thickness direction. A discharge port 3220 provided in the discharge-side nozzle 322 is in communication with the recessed portion 332 through a through hole penetrating the side wall 312 in the thickness direction.

The terminal mount portion 35 is disposed at a position different from positions on the outer surface of the side wall 312 of the main member 31 to which the suction-side nozzle 321 and the discharge-side nozzle 322 are connected. The terminal mount portion 35 has a shape projecting outward from the side wall 312 of the main member 31. One ends of the drive signal application electrode 251 and the drive signal application electrode 252 are mounted on the terminal mount portion 35. The portions of the drive signal application electrode 251 and the drive signal application electrode 252 mounted on the terminal mount portion 35 serve as supply portions of a drive signal from outside.

The lid member 40 is a flat plate and made of, for example, a metal. The outer shape of the lid member 40 is substantially the same as the shape of the inner side of the side wall 312 of the base housing 30, that is, the outer shape of the recessed portion 331. Note that the lid member 40 may be made of a material other than a metal as long as the thermal conductivity is higher than the base housing 30. In addition, as long as the thermal conductivity of the lid member 40 is higher than the thermal conductivity of the base housing 30, all of the lid member 40 may be a metal, and all of the base housing 30 does not have to be a resin. For example, even when the lid member 40 and the base housing 30 each have a metal portion and a resin portion, it is sufficient as long as the thermal conductivity of the lid member 40 is higher than the thermal conductivity of the base housing 30. However, the lid member 40 all of which is a metal is effective because the heat dissipation efficiency improves.

The pump body 20 is fitted to the recessed portion 332 of the base housing 30. At this time, the frame 212 comes into contact with a surface of the recessed portion 332, and the vibration plate 211 and the support 213 do not come into contact with the recessed portion 332. That is, as illustrated in FIG. 3, a suction-side space 101 is formed between the vibration plate 211 and the support 213, and the surface of the recessed portion 331. The suction-side space 101 corresponds to a "first space" of the present disclosure.

The lid member 40 is fitted to the recessed portion 331 of the base housing 30. At this time, since the height of the recessed portion 332 is adjusted, as illustrated in FIG. 3, a discharge-side space 102 is formed between the lid member 40, and the vibration plate 211 and the support 213 of the pump body 20. The discharge-side space 102 corresponds to a "second space" of the present disclosure.

With such a configuration, the pump body 20 is disposed in an internal space of the housing in a state in which the vibration plate 211 can vibrate. In addition, the outer wall surface on the suction-side space 101 side in the housing becomes a suction-side outer wall surface 130, and the outer surface on the discharge-side space 102 becomes a discharge-side outer wall surface 140.

When a drive signal is applied to the piezoelectric pump 10 having such a configuration by the drive signal application electrode 251 and the drive signal application electrode 252, the piezoelectric body of the piezoelectric element 22 is deformed, and the vibration plate 211 performs bending vibration. By the bending vibration, the pressure distribution of the suction-side space 101 mainly changes.

As a result, as the bold arrows in FIG. 3 indicate, a fluid (for example, air) flows into the suction-side space 101 from the suction port 3210 of the suction-side nozzle 321. The fluid that has flowed into the suction-side space 101 is transported into the discharge-side space 102 through a communication port 103 between the supports 213. The fluid transported into the discharge-side space 102 is carried out to the discharge port 3220 of the discharge-side nozzle 322 and is discharged to the outside.

At this time, by driving of the piezoelectric element 22, the piezoelectric element 22 generates heat, and the temperature of the internal space of the housing rises. In particular, the temperature of the discharge-side space 102, which becomes downstream of the transporting direction of the fluid, is likely to largely rise.

(Configurations of Piezoelectric Pump 10A and Piezoelectric Pump 10B)

As illustrated in FIG. 1, the piezoelectric pump 10A and the piezoelectric pump 10B are connected by the connection pipe 80. More specifically, a discharge-side nozzle 322A of the piezoelectric pump 10A and a suction-side nozzle 321B of the piezoelectric pump 10B are connected by the connection pipe 80. The discharge port of the discharge-side nozzle 322A of the piezoelectric pump 10A is in communication with the suction port of the suction-side nozzle 321B of the piezoelectric pump 10B through a hollow of the connection pipe 80.

In this configuration, the piezoelectric pump 10A and the piezoelectric pump 10B are driven. As a result, the fluid is sucked into the piezoelectric pump 10A from the suction port of the suction-side nozzle 321A of the piezoelectric pump 10A. The piezoelectric pump 10A discharges the sucked fluid into the connection pipe 80 from the discharge port of the discharge-side nozzle 322A of the piezoelectric pump 10A. The fluid discharged into the connection pipe 80 is sucked into the piezoelectric pump 10B from the suction port of the suction-side nozzle 321B of the piezoelectric pump 10B. The piezoelectric pump 10B discharges the sucked fluid to the outside from the discharge port of the discharge-side nozzle 322B of the piezoelectric pump 10B.

With such a configuration, the fluid is transported by the piezoelectric pump 10A and the piezoelectric pump 10B, whereby a high flow rate and pressure can be achieved compared with a case where the piezoelectric pump 10A and the piezoelectric pump 10B are used alone.

(Disposition Mode of Piezoelectric Pump 10A and Piezoelectric Pump 10B)

With reference to FIG. 3, as illustrated in FIG. 1, the piezoelectric pump 10A and the piezoelectric pump 10B are disposed such that a suction-side outer wall surface 130A of the piezoelectric pump 10A and a suction-side outer wall surface 130B of the piezoelectric pump 10B face each other. More specifically, the piezoelectric pump 10A and the piezoelectric pump 10B are disposed such that the suction-side outer wall surface 130A of the piezoelectric pump 10A and the suction-side outer wall surface 130B of the piezoelectric pump 10B face each other, come close to each other, and are substantially parallel to each other.

In other words, the piezoelectric pump 10A is disposed such that a discharge-side outer wall surface 140A faces a side opposite to the piezoelectric pump 10B side. The piezoelectric pump 10B is disposed such that a discharge-side outer wall surface 140B faces a side opposite to the piezoelectric pump 10A side.

As described above, in the piezoelectric pump 10A and the piezoelectric pump 10B, the temperature of the discharge-side space 102 is likely to rise. Therefore, by using the above-described disposition of the piezoelectric pump 10A and the piezoelectric pump 10B, even when the piezoelectric pump 10A and the piezoelectric pump 10B face and come close to each other, portions, of the piezoelectric pump 10A and the piezoelectric pump 10B, in which the temperature is likely to rise can be prevented from facing and coming close to each other. In addition, the outer wall surfaces (the discharge-side outer wall surfaces 140A and 140B) of the portions, of the piezoelectric pump 10A and the piezoelectric pump 10B, in which the temperature is likely to rise are exposed outward in the pump device 1 (a structure consisting of the piezoelectric pump 10A, the piezoelectric pump 10B, and the connection pipe 80)

As a result, heat is less likely to accumulate in the pump device 1 and effective heat dissipation can be achieved. Moreover, in this configuration, since the lid member 40 is a metal, the heat in the discharge-side space 102 of each of the piezoelectric pumps 10A and 10B is effectively propagated to the discharge-side outer wall surface through the lid member 40. Therefore, the heat in the discharge-side space 102 is more effectively dissipated to the outside.

In addition, in this configuration, the piezoelectric pump 10A and the piezoelectric pump 10B are not disposed such that the discharge-side nozzles and the suction-side nozzles of the piezoelectric pump 10A and the piezoelectric pump 10B face each other. Therefore, a shape that is significantly long in one direction is not formed as the pump device 1, a spatially compact shape is formed, and space saving can be achieved in the pump device 1. The spatially compact shape means that the difference between directions in the three orthogonal directions is small.

Moreover, in the configuration described above, the connection pipe 80 is a metal. As a result, heat dissipation can be performed in the connection pipe 80 as well. Therefore, the pump device 1 can more effectively dissipate the heat.

Second Embodiment

Figure 4:
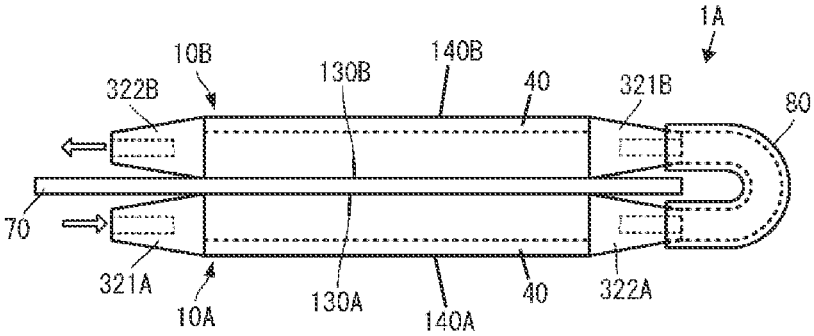
FIG. 4 is a side view illustrating a configuration of a pump device according to a second embodiment.

A pump device according to a second embodiment of the present disclosure will be described with reference to the drawings. FIG. 4 is a side view illustrating a configuration of the pump device according to the second embodiment.

As illustrated in FIG. 4, a pump device 1A according to the second embodiment is different from the pump device 1 according to the first embodiment in that a heat conductive member 70 is added. Other configurations of the pump device 1A are the same as the pump device 1, and the description of the same portions will be omitted.

The pump device 1A includes the heat conductive member 70. The heat conductive member 70 is, for example, a metal plate. The heat conductive member 70 is disposed between the piezoelectric pump 10A and the piezoelectric pump 10B. More specifically, the heat conductive member 70 is held between the suction-side outer wall surface 130A of the piezoelectric pump 10A and the suction-side outer wall surface 130B of the piezoelectric pump 10B.

With such a configuration, the piezoelectric pump 10A can dissipate the heat from the suction-side outer wall surface 130A through the heat conductive member 70. Similarly, the piezoelectric pump 10B can dissipate the heat from the suction-side outer wall surface 130B through the heat conductive member 70.

Therefore, the piezoelectric pump 10A can more effectively dissipate the heat.

Note that the plane area of the heat conductive member 70 is preferably larger than the areas of the piezoelectric pump 10A and the piezoelectric pump 10B in plan view. In addition, in plan view, the piezoelectric pump 10A and the piezoelectric pump 10B preferably overlap with the heat conductive member 70. As a result, the piezoelectric pump 10B can more effectively dissipate the heat.

In addition, the heat conductive member 70 is not limited to a metal as long as the thermal conductivity of the heat conductive member 70 is higher than the thermal conductivity of the piezoelectric pump 10A and the piezoelectric pump 10B. Note that the thermal conductivity of the piezoelectric pumps 10A and 10B here is the thermal conductivity of the base housing 30 which the heat conductive member 70 faces.

In addition, in the configuration of FIG. 4, the heat conductive member 70 is in direct contact with the piezoelectric pump 10A and the piezoelectric pump 10B, but the heat conductive member 70 may be in indirect contact with the piezoelectric pump 10A and the piezoelectric pump 10B, or there may be a gap or the like between the heat conductive member 70, and the piezoelectric pump 10A and the piezoelectric pump 10B. In the case of an indirect contact, for example, grease or an adhesive having thermal conductivity may be used.

In addition, the heat conductive member 70 preferably have a shape and is disposed such that the fluid that is discharged from the discharge-side nozzle 322B of the piezoelectric pump 10B passes the surface of the heat conductive member 70. As a result, in the heat conductive member 70, the heat is also dissipated by the fluid discharged from the pump device TA.

Third Embodiment

Figure 5:
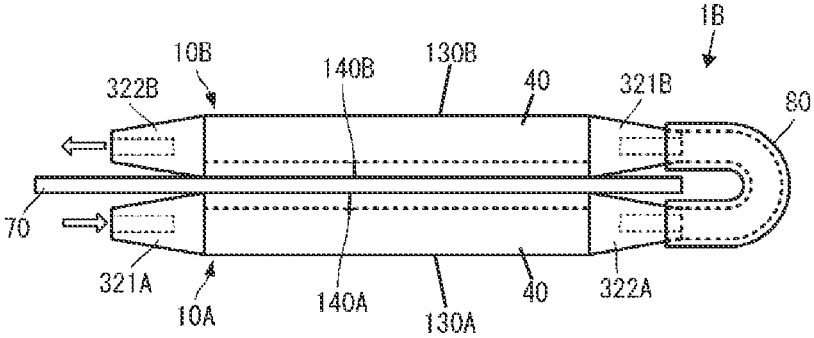
FIG. 5 is a side view illustrating a configuration of a pump device according to a third embodiment.

A pump device according to a third embodiment of the present disclosure will be described with reference to the drawings. FIG. 5 is a side view illustrating a configuration of the pump device according to the third embodiment.

As illustrated in FIG. 5, a pump device 1B according to the third embodiment is different from the pump device 1A according to the second embodiment in the disposition of the piezoelectric pump 10A and the piezoelectric pump 10B. Other configurations of the pump device 1B are the same as the pump device 1A, and the description of the same portions will be omitted.

In the pump device 1B, the piezoelectric pump 10A and the piezoelectric pump 10B are disposed such that the discharge-side outer wall surface 140A of the piezoelectric pump 10A and the discharge-side outer wall surface 140B of the piezoelectric pump 10B face each other, come close to each other, and are substantially parallel to each other.

The heat conductive member 70 is held between the discharge-side outer wall surface 140A and the discharge-side outer wall surface 140B.

With such a configuration, the pump device 1B can effectively dissipate the heat, to the outside, from the discharge-side outer wall surface 140A and the heat from the discharge-side outer wall surface 140B through the heat conductive member 70.

Fourth Embodiment

Figure 6:
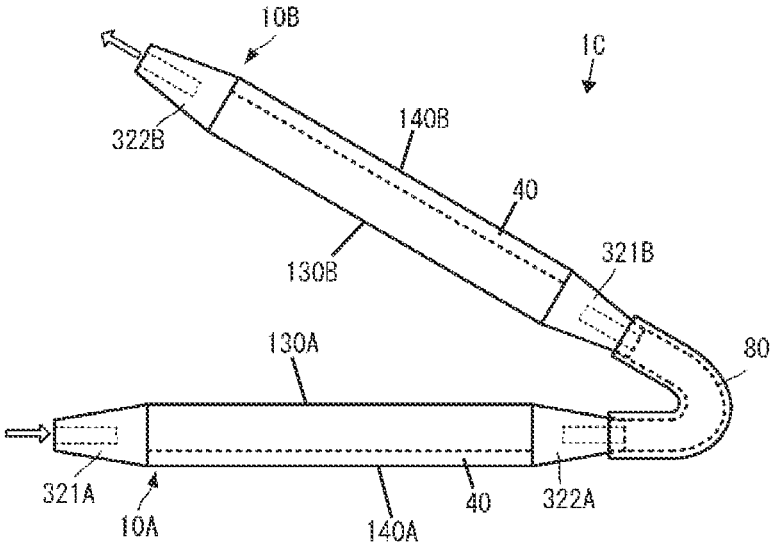
FIG. 6 is a side view illustrating a configuration of a pump device according to a fourth embodiment.

A pump device according to a fourth embodiment of the present disclosure will be described with reference to the drawings. FIG. 6 is a side view illustrating a configuration of the pump device according to the fourth embodiment.

As illustrated in FIG. 6, a pump device 1C according to the fourth embodiment is different from the pump device 1 according to the first embodiment in the disposition of the piezoelectric pump 10A and the piezoelectric pump 10B. Other configurations of the pump device 1C are the same as the pump device 1, and the description of the same portions will be omitted.

In the pump device 1C, the piezoelectric pump 10A and the piezoelectric pump 10B are not disposed so as to be parallel to each other and are disposed so as to form a predetermined angle. For example, as illustrated in FIG. 6, the suction-side outer wall surface 130A of the piezoelectric pump 10A and the suction-side outer wall surface 130B of the piezoelectric pump 10B form an angle smaller than 90°.

Even with such a configuration, the pump device 1C can effectively dissipate the heat.

Fifth Embodiment

Figure 7:
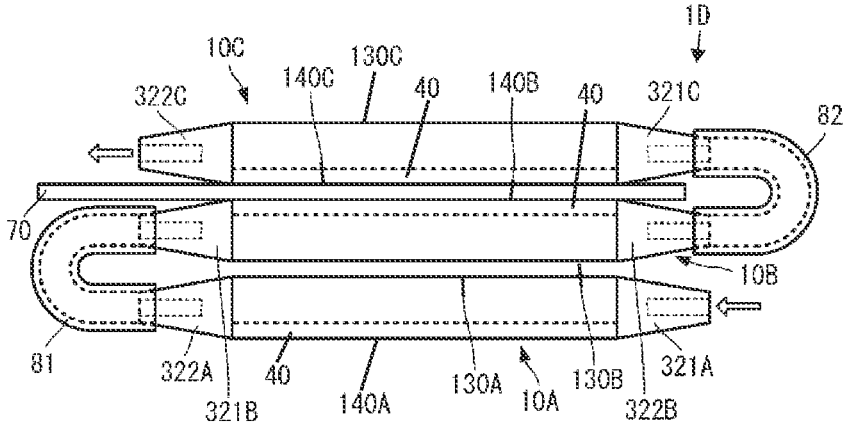
FIG. 7 is a side view illustrating a configuration of a pump device according to a fifth embodiment.

A pump device according to a fifth embodiment of the present disclosure will be described with reference to the drawings. FIG. 7 is a side view illustrating a configuration of the pump device according to the fifth embodiment.

As illustrated in FIG. 7, a pump device 1D according to the fifth embodiment is different from the pump device 1 according to the first embodiment and the pump device 1B according to the third embodiment in that three piezoelectric pumps are used. Other configurations of the pump device 1D are the same as the pump devices 1 and 1B, and the description of the same portions will be omitted.

The pump device 1D includes the piezoelectric pump the piezoelectric pump 10B, a piezoelectric pump 10C, a connection pipe 81, a connection pipe 82, and the heat conductive member 70. The piezoelectric pump 10A, the piezoelectric pump 10B, and the piezoelectric pump 10C have the same configurations.

The piezoelectric pump 10A and the piezoelectric pump 10B are disposed such that the suction-side outer wall surface 130A of the piezoelectric pump 10A and the suction-side outer wall surface 130B of the piezoelectric pump 10B face each other and come close to each other. The piezoelectric pump 10B and the piezoelectric pump 10C are disposed such that the discharge-side outer wall surface 140B of the piezoelectric pump 10B and a discharge-side outer wall surface 140C of the piezoelectric pump 10C face each other and come close to each other. In the piezoelectric pump 10A, the discharge-side outer wall surface 140A is exposed outward. In the piezoelectric pump a suction-side outer surface 130C is exposed outward.

The discharge-side nozzle 322A of the piezoelectric pump 10A and the suction-side nozzle 321B of the piezoelectric pump 10B are connected and caused to be in communication with each other by the connection pipe 81. The discharge-side nozzle 322B of the piezoelectric pump 10B and a suction-side nozzle 321C of the piezoelectric pump 10C are connected and caused to be in communication by the connection pipe 82.

The heat conductive member 70 is held between the discharge-side outer wall surface 140B of the piezoelectric pump 10B and the discharge-side outer wall surface 140C of the piezoelectric pump 10C.

In this configuration, the piezoelectric pump 10A, the piezoelectric pump 10B, and the piezoelectric pump 10C are driven. As a result, a fluid from the suction port of the suction-side nozzle 321A of the piezoelectric pump 10A is sucked into the piezoelectric pump 10A. The piezoelectric pump 10A discharges the sucked fluid into the connection pipe 81 from the discharge port of the discharge-side nozzle 322A of the piezoelectric pump 10A.

The fluid discharged into the connection pipe 81 is sucked from the suction port of the suction-side nozzle 321B of the piezoelectric pump 10B into the piezoelectric pump 10B. The piezoelectric pump 10B discharges the sucked fluid into the connection pipe 82 from the discharge port of the discharge-side nozzle 322B of the piezoelectric pump 10B.

The fluid discharged into the connection pipe 82 is sucked into the piezoelectric pump 10C from the suction port of the suction-side nozzle 321C of the piezoelectric pump 10C. The piezoelectric pump 10C discharges the sucked fluid to the outside from the discharge port of a discharge-side nozzle 322C of the piezoelectric pump 10C.

With such a configuration, the fluid is transported by the piezoelectric pump 10A, the piezoelectric pump 10B, and the piezoelectric pump 10C, whereby a higher flow rate can be achieved.

In addition, since the piezoelectric pump 10A, the piezoelectric pump 10B, and the piezoelectric pump 10C are in the above-described disposition mode, a shape that is significantly long in one direction is not formed as the pump device 1D, a spatially compact shape is formed, and space saving can be achieved in the pump device 1D.

In addition, by the above-described disposition mode, in the piezoelectric pump 10A and the piezoelectric pump 10B, the discharge-side outer wall surface 140A and the discharge-side outer wall surface 140B do not come close to each other and face each other. Moreover, although in the piezoelectric pump 10B and the piezoelectric pump 10C, the discharge-side outer wall surface 140B and the discharge-side outer wall surface 140C come close to each other and face each other, the heat conductive member 70 is held therebetween.

As a result, although the pump device 1D includes the three piezoelectric pumps 10A, 10B, and 10C, the pump device 1D can effectively dissipate the heat.

Note that in the pump device 1D, the heat conductive member 70 may be disposed between the piezoelectric pump 10A and the piezoelectric pump 10B.

In addition, by adopting this configuration, even when the number of piezoelectric pumps is four or more, the pump device can achieve effective heat dissipation.

Note that the configurations of the embodiments described above can be appropriately combined, and effects can be exhibited according to each combination.

1, 1A, 1B, 1C, 1D PUMP DEVICE
10A, 10B, 10C PIEZOELECTRIC PUMP
20 PUMP BODY
22 PIEZOELECTRIC ELEMENT
30 BASE HOUSING
31 MAIN MEMBER
33 RECESSED PORTION
35 TERMINAL MOUNT PORTION
40 LID MEMBER
70 HEAT CONDUCTIVE MEMBER
81, 82 CONNECTION PIPE
101 SUCTION-SIDE SPACE
102 DISCHARGE-SIDE SPACE
103 COMMUNICATION PORT
130, 130A, 130B, 130C SUCTION-SIDE OUTER WALL SURFACE
140, 140A, 140B, 140C DISCHARGE-SIDE OUTER WALL SURFACE
211 VIBRATION PLATE
212 FRAME
213 SUPPORT
251, 252 DRIVE SIGNAL APPLICATION ELECTRODE
311 BOTTOM WALL
312 SIDE WALL
321, 321A, 321B, 321C SUCTION-SIDE NOZZLE
322, 322A, 322B, 322C DISCHARGE-SIDE NOZZLE
331, 332, 333 RECESSED PORTION
3210 SUCTION PORT
3220 DISCHARGE PORT

The invention claimed is:

1. A pump device comprising:

a first piezoelectric pump and a second piezoelectric pump each including a housing, a suction port, and a discharge port, the housing having an internal space, a vibration plate configured to vibrate by driving of a piezoelectric element is disposed in the internal space, the suction port being in communication with a first space surrounded by the housing and one main surface of the vibration plate in the internal space of the housing, and the discharge port being in communication with a second space surrounded by the housing and another main surface of the vibration plate in the internal space of the housing; and a connection pipe causing the discharge port of the first piezoelectric pump to be in communication with the suction port of the second piezoelectric pump, wherein the first piezoelectric pump and the second piezoelectric pump are disposed such that an outer wall surface on a first space side in the housing of the first piezoelectric pump faces an outer wall surface on the first space side in the housing of the second piezoelectric pump, and the connection pipe is connected to the discharge port of the first piezoelectric pump and the suction port of the second piezoelectric pump.

2. The pump device according to claim 1, wherein a wall on a second space side in the housing of the first piezoelectric pump has a thermal conductivity higher than a wall on the first space side, and a wall on the second space side in the housing of the second piezoelectric pump has a thermal conductivity higher than a wall on the first space side.

3. The pump device according to claim 2, wherein the wall on the second space side in the housing of the first piezoelectric pump is a metal, the wall on the first space side in the housing of the first piezoelectric pump is a resin, the wall on the second space side in the housing of the second piezoelectric pump is a metal, and the wall on the first space side in the housing of the second piezoelectric pump is a resin.

4. The pump device according to claim 1, wherein the connection pipe has a thermal conductivity higher than the housing.

5. The pump device according to claim 4, wherein the connection pipe is a metal.

* * * * *